United States Patent [19]

Kvarnegård

[11] 4,131,796

[45] Dec. 26, 1978

[54] APPARATUS FOR THERMOGRAPHIC DUPLICATION OF INFORMATION

[75] Inventor: Sven B. Kvarnegård, Enebyberg, Sweden

[73] Assignee: AB Carl Lamm, Stockholm, Sweden

[21] Appl. No.: 721,235

[22] Filed: Sep. 8, 1976

[51] Int. Cl.[2] ..... G03C 5/16

[52] U.S. Cl. ..... 250/319; 250/318

[58] Field of Search ..... 250/319, 318, 316; 355/3 TE, 3 DR, 3 R; 118/641, 644

[56] References Cited

U.S. PATENT DOCUMENTS

| | | | |
|---|---|---|---|
| 2,501,495 | 3/1950 | Carroll et al. | 250/318 |
| 2,503,758 | 4/1950 | Murray | 250/318 |

*Primary Examiner*—Alfred E. Smith
*Assistant Examiner*—B. C. Anderson
*Attorney, Agent, or Firm*—Eyre, Mann, Lucas & Just

[57] ABSTRACT

An improvement in carrying heat away from the drum in a thermographic duplication apparatus. The drum is formed of two concentric shells, the outer being only a segment of a cylinder.

11 Claims, 2 Drawing Figures

APPARATUS FOR THERMOGRAPHIC DUPLICATION OF INFORMATION

Figure 1:
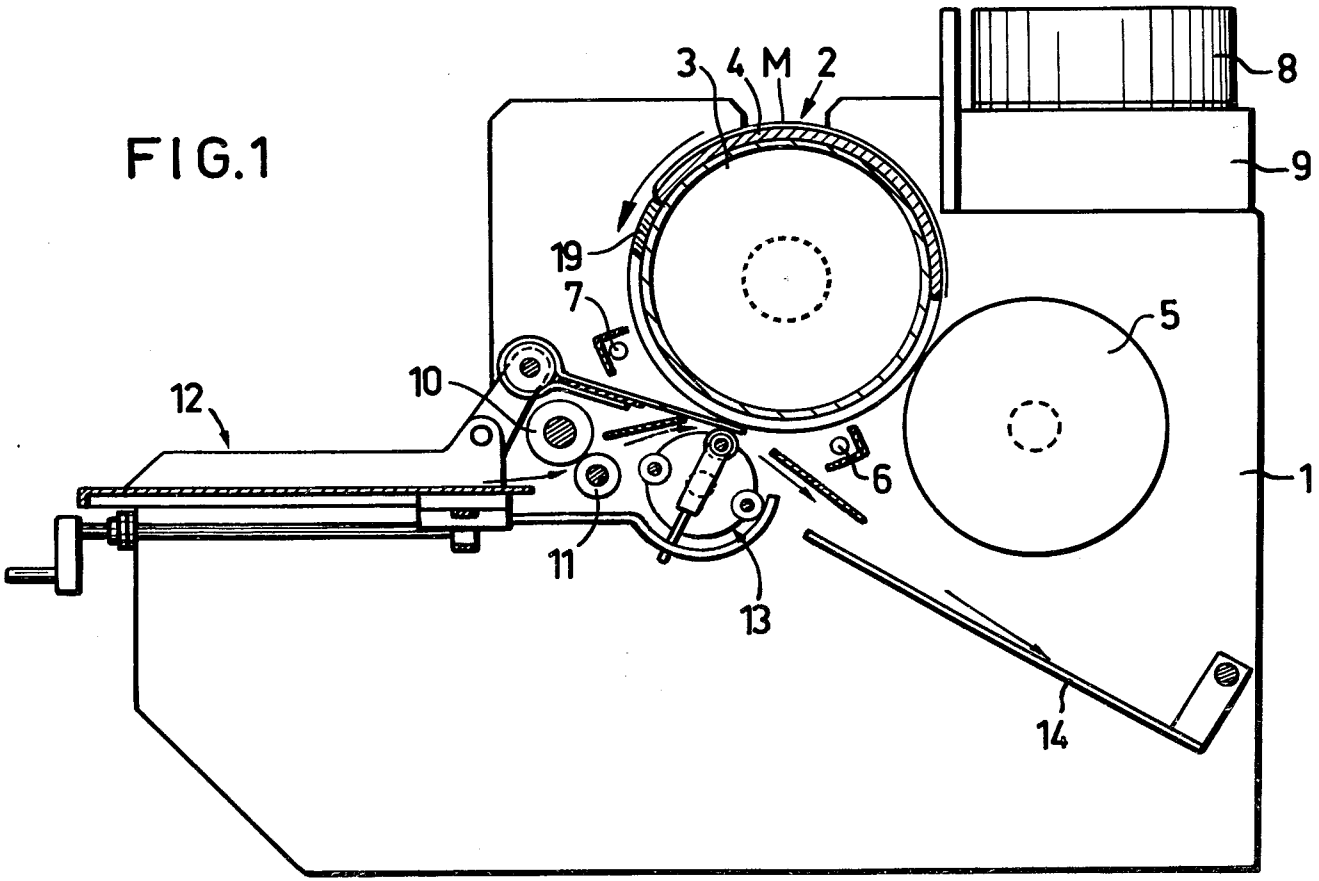

This invention relates to an improvement of an apparatus according to the preamble of claim 1.

Such an apparatus is previously known through, for example, the Swedish patent specification 317 391 and the Swedish patent application 7502769-8.

The rotatable drum, which is provided to carry on a portion of its shell surface the original during the duplication operation and premanently to start and stop its rotation in a substantially given angular position, during the duplication operation is subjected with the portion carrying the original and moving past one or more radiation sources to a concentrated radiation of high intensity, particularly within the infrared wave length range, so that the radiation absorbing picture of the original will be heated to a temperature higher than the ambient. A carrier of a layer of dye composition is thereafter moved into intimate contact with the original in agreement with its heated picture. A copy receiving sheet is thereafter brought into intimate contact with the dyed original and thereby takes up the picture of the original.

As is easily understood, during a long period of uninterrupted operation the heat transferred to the original and therewith to the drum will exceed the heat led away through the stand of the apparatus, the copy receiving sheets and the air. The heat, thus, is stored in the drum. This implies increase in heat also of the original, i.e. the difference between the heat of the radiation absorbing picture and the heat of the original absorbing less heat decreases, which in its turn implies that also the original proper will be dyed by dye and, consequently, the picture transferred to the copy receiving sheet will become increasingly blurred.

The procedure described in general above involves, that the operation can go on continuously only for short periods, and the machine, the drum, must be allowed to cool in the intervals between the periods. This constitutes an essential disadvantage at the use of machines operating after the thermographic method.

The method will operate relatively slowly at the production of long series of copies and, thereby, become less attractive.

It has since a long time been the aim within this field to reduce or eliminate the cooling intervals and thereby to increase the operation speed of the machine.

Attempts have therefore been made to conduct heat away from the drum in some way or to prevent heat from getting to the drum. An advanced example of such an attempt is dealt with in the Swedish patent specification 317 391, according to which the shell surface of the drum is divided into two parts, of which one part, which carries and supports the original, is made of heat insulating material, and the second part of material with radiation reflecting properties.

In spite of the fact that the parts of the drum are separated from each other, and the part not intended to carry the original is to receive the pre- and after-radiation from the radiation sources, the desired result of preventing the drum from being heated over a permissible temperature is not achieved, nor can this known apparatus be operated continuously without stoppage for being cooled.

The reason is, that the drum in spite of its design is supplied with more heat than can be conducted away from the drum. It is not possible to maintain a heat balance, which is sufficiently low for producing long series of copies.

The present invention has the object to overcome the aforesaid disadvantages. This object is achieved thereby that the invention has been given the characterizing features defined in the claims.

Figure 2:
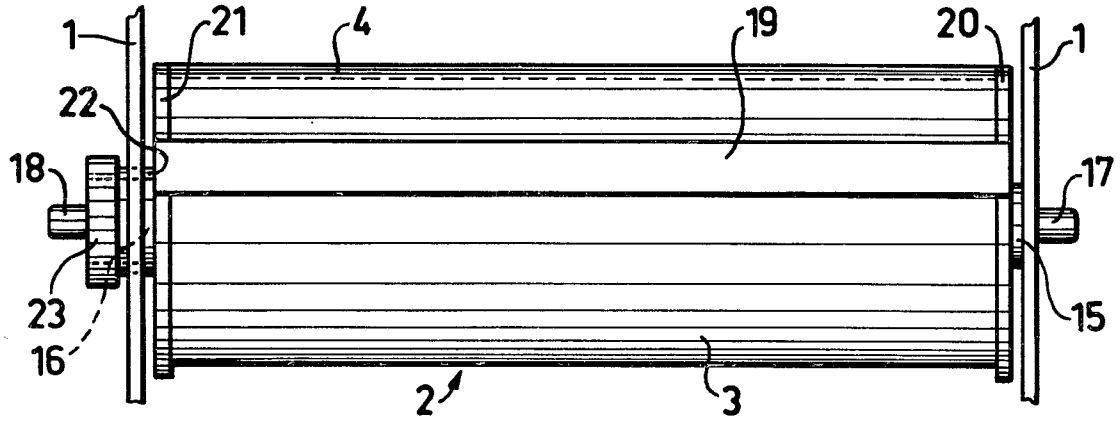

The invention is described in greater detail in the following by way of an embodiment with reference to the accompanying drawings, in which FIG. 1 is a schematic view of a cross-section through the apparatus, and FIG. 2 is a view of the drum proper, the remaining parts of the apparatus being removed.

The apparatus shown schematically in FIG. 1 comprises a stand 1, in which a drum generally designated by 2 is rotatably supported and driven in a conventional manner by a motor. The drum is designed so as in known manner be able to carry an original or a master M. A dye carrier schematically shown at 5 is provided in known manner to act against the drum and therewith against the master. The apparatus further is provided with two radiation sources 6, 7 of known type. These sources are provided with reflector means, which are cooled by a liquid pumped past the radiation sources and cooled in a cooler 9 subjected to the air action of fans 8. The apparatus further comprises a pair of cooperating feed rollers 10, 11 for feeding a copy receiving sheet lying on a table 12 to a rotatable pressure roller unit 13. The copy receiving sheets provided with information from the master are discharged to a guide plate 14 for continued handling. The principle of this thermographic copying is per se well-known and, therefore, not dealt with in detail, but reference is made to the Swedish patent specification 317 391 and the Swedish patent application 7502769-8, for example, from which also the form and function of the remaining details become apparent. These details are not part of the subject matter of the present invention and there is, thus, no reason here for explaining them in greater detail.

The drum 2 according to the invention comprises two parts, viz. a core or cylinder 3 and a cylindric shell segment 4 rotatable about said cylinder 3. The cylinder 3 is at one end non-rotatably attached by a cylindric pin 15 to the stand 1 (FIG. 2). The other end of the cylinder is provided with a journal 16. The cylinder 3 is hollow or in a suitable manner provided with cooling passages for a cooling liquid, which by said pump (not shown) is circulated through the cylinder via cooling liquid inlet 17 and a cooling liquid outlet 18 and the cooler 9. The cylinder 3 preferably is made of a heat-resistant material and polished on its surface.

The cylindric shell segment 4 is intended to carry the master M, which is provided with the heat absorbing information in question. The shell segment 4, therefore, is provided with a clamping jaw 19 for attaching the master M to the shell segment. Such clamping jaws are per se known and will not described here in detail. The shell segment 4 consists of a well heat-conducting material, preferably aluminium, and is positioned so as to terminate very closely to the cylinder 3.

The shell segment 4 according to the embodiment shown is provided with a pair of end pieces 20 and 21. The end piece 20 is provided with a bearing bore and supported freely rotatably about the cylindric pin 15 of the cylinder 3. The end piece 21 is provided with an axle journal 22 extending through the bearing hole and supported rotatably in the stand 1. On the axle journal 22 a drive belt wheel 23 is mounted. A drive belt (not shown) from a motor drives in desired manner the shell segment 4. The bearing pin 16 of the cylinder 3, as appears from FIG. 2, is supported in the bearing bore of the axle journal 22.

It is understood from the above description that the shell segment 4 during the operation of the apparatus rotates about the idle cylinder 3.

The shell segment 4 is started and stopped during the copying process for each revolution in a definite angular position, the starting position, in accordance with the established known art in this field.

As appears from FIG. 1, the shell segment 4 extends slightly beyond half of the circumference of the cylinder 3. The segment is shown in the Figure in starting position, in which the shell segment 4 is removed from the radiation source 7, pressure roller unit 13, radiation source 6 and dye carrier 5.

In the following is assumed that the starting position occupied in FIG. 1 has been arrived at with the master M dyed in accordance with the information applied. When a copy receiving sheet on the table 12 is advanced to the feed rollers 10 and 11, in a given position thereof the radiation source 7 is lightened, the shell segment 4 is started and moved past the radiation source 7, which then has reached full intensity and renders the information on the master M fluid, and the advanced copy receiving sheet is pressed by the pressure roller unit 13 against the master M on the shell segment 4 and discharged via the guide plate 14. During this time, the radiation source 6 for the heating of information on the master M has been lightened and has reached its full intensity when the shell segment 4 is moving past the same, which segment during the continued rotation moves the master M past the dye carrier 5 for dying the information on the master M, whereafter the shell segment 4 stops in the starting position. When the shell segment 4 gradually moves past the radiation sources 7 and 6, the sources will be extinguished. The infrared radiators here used as heat radiation sources, like most of the heat radiators, have a certain inertia, i.e. after their lightning a certain time is required until they reach full intensity, and after they have been extinguished also a certain time is required until they are fully extinguished. At continuous operation heat gradually is stored also in the heat radiators proper, in their armature and in surrounding parts of the apparatus.

At copying only the intense heat radiation period is of interest. All other heat can be detrimental for the purpose intended, as pointed out in the introductory portion of the description. It is this detrimental heat, which according to the invention is prevented from affecting the copying result.

From the aforesaid is apparent as follows:

The radiation source 7 is lightened before the shell segment 4 arrives there. The heat emitted before the source 7 reaches full intensity meets only the liquid-cooled cylinder 3.

The same applies to the radiation source 6.

The radiation source 7 is extinguished immediately before the shell segment 4 has passed, so that the after-radiation from the source meets the liquid-cooled cylinder 3.

The same applies to the radiation source 6.

The heat received by the cylinder 3 is conducted away by the cooling medium.

The heat stored in the shell segment 4 during the copying operation is transferred to and conducted away by the cylinder 3, because the segment terminates closely adjacent the cylinder.

A heat balance, thus, has been obtained on the low level necessary for the functioning of the apparatus.

In order to additionally increase the heat transfer between the shell segment 4 and cylinder 3, it is possible to arrange the shell segment supported directly on the cylinder, i.e. the segment will float thereon.

The low level of the heat balance can be optimized by a suitable choice of lightening items for the radiation sources in relation to the rotation and speed of the shell segment 4 as well as by the choice of flowing paths and capacity of the cooling liquid. By rendering the radiation effect variable, the heat accumulated in the radiation sources and in their armatures during the state of inertia can be compensated for by reducing the effect supplied to the radiation sources. Between the shell segment and master also a layer of a heat-insulating material can be applied.

At an apparatus according to the invention applied in practice, a third of the radiation heat emitted from the respective radiation source was permitted to meet the shell segment with the master for each revolution, while the remaining two thirds of the radiation heat met the cooled cylinder.

As mentioned, only one embodiment of the invention has been described which, of course, can be varied within the scope of the attached claims. Also the cylinder, for example, may be permitted to rotate.

What I claim is:

1. An apparatus for copying information from an original or master (M) provided with information comprising a rotatable drum, to which the master (M) with applied information is attached, and the master (M) during the rotation of the drum is exposed to directed heat radiation from one or more heat radiation sources outside said drum spaced from said master and is supplied with a dye carrier, the dye of which thereby adheres to the master (M) in accordance with the information applied thereon, whereafter unprepared copy receiving sheets are brought into contact with the master (M) and thereafter removed therefrom, characterized in that the drum comprised two portions separated and movable relative to each other, of which the first portion is a cooled cylinder, and the second portion is a segment of a cylindric shell concentric with said cylinder and closely abutting but movable about the surface of the cylinder, means for attachment of said master (M) to said segment and wherein said segment of a cylindric shell is only a part of a cylinder and does not extend about the entire circumference of the cylinder whereby said cylinder is directly subjected to said directed heat radiation during a portion of a complete revolution of the said segment.

2. An apparatus according to claim 1, characterized in that the cylinder is rigidly attached to a stand of the apparatus.

3. An apparatus according to claim 1, characterized in that the cylinder is provided with an inner cavity and with inlet and outlet for a coolant intended to flow through the cylinder.

4. An apparatus according to claim 1, characterized in that the said segment is supported rotatably about the axle of the cylinder in bearings on each side of the cylinder.

5. An apparatus according to claim 1, characterized in that the said segment is supported rotatably movably directly floating on the cylinder.

6. An apparatus according to claim 1, characterized in that the forward edge of the said segment in the rotation direction is arranged to be at a certain peripheral distance from the nearmost heat radiator upon actuation of the latter.

7. An apparatus according to claim 6, characterized in that the rearward edge of the said segment in the rotation direction is arranged so that it has left the nearmost heat radiator with a certain peripheral distance, before the radiator has stopped emitting direct heat radiation after it has been extinguished.

8. An apparatus according to claim 1, characterized in that a heat-insulating layer is provided between the shell segment and the master (M).

9. An apparatus according to claim 1, characterized in that the cylinder is made of a good heat-conducting material and has a polished surface.

10. An apparatus according to claim 1, characterized in that the said segment is made of a good heat-conducting material.

11. An apparatus according to claim 1 wherein the said segment extends about substantially half of the circumference of the cylinder.

* * * * *